US010273565B2

(12) United States Patent
Iwanaga et al.

(10) Patent No.: US 10,273,565 B2
(45) Date of Patent: Apr. 30, 2019

(54) HIGHLY CORROSION-RESISTANT AND WEAR-RESISTANT MEMBER WITH THERMAL-SPRAYED LAYER FORMED THEREON AND THERMAL-SPRAYED LAYER FORMING POWDER FOR FORMING THE SAME

(71) Applicant: TOYO KOHAN CO., LTD, Tokyo (JP)

(72) Inventors: Kengo Iwanaga, Kudamatsu (JP); Yuji Yamazaki, Kudamatsu (JP); Kourou Hirata, Kudamatsu (JP)

(73) Assignee: TOYO KOHAN CO., LTD., Tokyo (JP)

( * ) Notice: Subject to any disclaimer, the term of this patent is extended or adjusted under 35 U.S.C. 154(b) by 186 days.

(21) Appl. No.: 14/944,316

(22) Filed: Nov. 18, 2015

(65) Prior Publication Data

US 2016/0068935 A1 Mar. 10, 2016

Related U.S. Application Data

(62) Division of application No. 13/263,934, filed as application No. PCT/JP2009/001058 on Mar. 10, 2009, now Pat. No. 9,228,253.

(51) Int. Cl.

| | |
|---|---|
| ***C23C 4/10*** | (2016.01) |
| ***C22C 29/14*** | (2006.01) |
| ***B22F 1/00*** | (2006.01) |
| ***C23C 4/06*** | (2016.01) |

(52) U.S. Cl.

CPC ..... *C22C 29/14* (2013.01); *B22F 1/0096* (2013.01); *C23C 4/06* (2013.01); *C23C 4/10* (2013.01); *Y10T 428/12826* (2015.01)

(58) Field of Classification Search

None

See application file for complete search history.

(56) References Cited

U.S. PATENT DOCUMENTS

| | | | | |
|---|---|---|---|---|
| 2,776,468 | A | 1/1957 | Steinitz | 75/244 |
| 5,022,919 | A | 6/1991 | Shinozaki et al. | 75/238 |
| 5,238,481 | A | 8/1993 | Takagi et al. | 75/244 |
| 5,328,763 | A | 7/1994 | Terry | 428/559 |
| 6,030,429 | A | 2/2000 | Yamazaki et al. | 75/244 |
| 6,376,103 | B1 | 4/2002 | Sampath et al. | 428/663 |
| 6,984,255 | B2 | 1/2006 | Itsukaichi et al. | 75/252 |

FOREIGN PATENT DOCUMENTS

| | | |
|---|---|---|
| JP | 62-196353 | 8/1987 |
| JP | 08-104969 | 4/1996 |
| JP | 09-013177 | 1/1997 |

OTHER PUBLICATIONS

Takagi, J. Solid State Chemistry, 179, 2009, 2809-2818.

*Primary Examiner* — Jessee R Roe
*Assistant Examiner* — Ngoclan T Mai
(74) *Attorney, Agent, or Firm* — Browdy and Neimark, P.L.L.C.

(57) ABSTRACT

Provided is a corrosion-resistant and wear-resistant member where a thermal-sprayed layer having corrosion resistance and wear resistance is formed on a surface of a metallic member which is brought into contact with a resin which generates a highly corrosive gas. Also provided is a thermal-spraying powder. The highly corrosion-resistant and wear-resistant member having a thermal-sprayed layer is one obtained by thermally spraying metallic powder on a metallic base material to form a thermal-sprayed layer on a surface of the metallic base material. The member is characterized in that the thermal-sprayed layer is a composite boride cermet of a tetragonal $Mo_2$ (Ni,Cr) $B_2$-type or a tetragonal $Mo_2$ (Ni, Cr, V) $B_2$-type. The powder for forming a thermal-sprayed layer is made of a composite boride cermet of a $Mo_2$ (Ni, Cr) $B_2$-type and comprises 4.0 to 6.5 mass % of boron, 39.0 to 64.0 mass % of molybdenum, and 7.5 to 20.0 mass % of chromium, a balance being 5 mass % or more of nickel and unavoidable elements.

7 Claims, No Drawings

HIGHLY CORROSION-RESISTANT AND WEAR-RESISTANT MEMBER WITH THERMAL-SPRAYED LAYER FORMED THEREON AND THERMAL-SPRAYED LAYER FORMING POWDER FOR FORMING THE SAME

This application is a divisional of application Ser. No. 13/263,934, filed Jan. 4, 2012, now U.S. Pat. No. 9,228,253.

TECHNICAL FIELD

The present invention relates to a corrosion-resistant and wear-resistant member where a thermal-sprayed layer is formed on a surface of a metallic base material by thermally spraying metal power on the surface of a metallic base material. The present invention, more particularly, relates to a corrosion-resistant and wear-resistant member where a thermal-sprayed layer formed of metallic powder constituted of a hard phase which is mainly made of composite boride of a $Mo_2$ (Ni, Cr) $B_2$-type or a $Mo_2$ (Ni, Cr, V) $B_2$-type and a binder phase for binding the hard phase which is mainly made of Ni, Cr is formed on a metallic base material, and a thermal-sprayed layer forming powder for forming the thermal-sprayed layer.

BACKGROUND ART

Conventionally, it is often the case where surface properties of a metallic base material are enhanced by thermally spraying metallic powder or the like to a surf ace of the metallic base material. This thermally spraying method can be performed relatively easily and hence, the thermally spraying method has been widely applied to various kinds of members. Particularly, the thermally spraying method has been used in various industrial fields as an effective technique when it is necessary to partially impart corrosion resistance and wear resistance to a surface of a metallic base material. In general, as a powder material which is used as thermal spraying powder to be thermally sprayed to a surface of a metallic base material, an Ni-based self-fluxing alloy, a Co-based stellite alloy and the like are used.

However, although the Ni-based self-fluxing alloy, the Co-based stellite alloy and the like exhibit excellent adhesiveness with abase material, a thermal-sprayed layer formed by such materials improves material properties thereof by solid-solution strengthening or precipitation hardening and hence, these materials are insufficient in terms of corrosion resistance and wear resistance of the thermal-sprayed layer.

On the other hand, with respect to ceramic which is considered to exhibit excellent corrosion resistance and wear resistance, cracks are liable to occur in a thermal-sprayed layer due to porosity of a skin film so that the thermal-sprayed layer is liable to be peeled off from the base material.

In view of such circumstances, there has been proposed a thermal-sprayed film which is made of a cermet having properties between properties of metal and ceramic. Particularly, a WC—Co cermet material is, because of its high hardness, used in applications which require wear resistance. However, the WC—Co cermet material has a drawback that a counterpart material is abraded.

Further, a cermet material which contains a composite boride of Ni, Mo or W is used from a viewpoint of reduction of abrasion of a counterpart material, the cermet material has a drawback in terms of corrosion resistance and wear resistance when the cermet material is brought into contact with a resin which generates a highly corrosive gas such as a molten fluororesin or PPS.

Patent document 1: JP-A-8-104969

DISCLOSURE OF INVENTION

Task to be Solved by the Invention

It is an object of the present invention to provide a corrosion-resistant and wear-resistant member where a thermal-sprayed layer having corrosion resistance and wear resistance is formed on a surface of a metallic member which is brought into contact with a resin which generates a highly corrosive gas such as a molten fluororesin or PPS, for example, on a surface of a member of a resin molding machine.

Further, it is also an object of the present invention to provide thermally spraying powder for forming the thermal-sprayed layer.

Means for Solving the Task (1) A highly corrosion-resistant and wear-resistant member with a thermal-sprayed layer formed thereon according to the present invention is a corrosion-resistant and wear-resistant member where a thermal-sprayed layer is formed on a surface of a metallic base material by thermally spraying metallic powder on the metallic base material, wherein the thermal-sprayed layer is made of a composite boride cermet of a tetragonal $Mo_2$ (Ni,Cr) $B_2$-type.

(2) A highly corrosion-resistant and wear-resistant member with a thermal-sprayed layer formed thereon according to the present invention is a corrosion-resistant and wear-resistant member where a thermal-sprayed layer is formed on a surface of a metallic base material by thermally spraying metallic powder on the metallic base material, wherein the thermal-sprayed layer is made of a composite boride cermet of a tetragonal $Mo_2$ (Ni, Cr, V) $B_2$-type.

(3) Powder for forming a thermal-sprayed layer according to the present invention is made of a composite boride cermet of a tetragonal $Mo_2$ (Ni,Cr) $B_2$-type, and contains 4.0 to 6.5 mass % of B (% being mass % in this specification unless otherwise specified), 39.0 to 64.0 mass % of Mo, and 7.5 to 20.0 mass % of Cr, a balance being 5 mass % or more of Ni and unavoidable elements.

(4) Powder for forming a thermal-sprayed layer according to the present invention is made of a composite boride cermet of a tetragonal $Mo_2$ (Ni, Cr, V) $B_2$-type, and contains 4.0 to 6.5 mass % of B, 39.0 to 64.0 mass % of Mo, 7.5 to 20.0 mass % of Cr, and 0.1 to 10.0 mass % of V, a balance being 5 mass % or more of Ni and unavoidable elements.

(5) Powder for forming a thermal-sprayed layer according to the present invention is thermal spraying powder which is formed of mixed powder consisting of tetragonal $Mo_2$ (Ni, Cr) $B_2$ which contains 7 to 9 mass % of B, 60 to 80 mass % of Mo, and 7.5 to 20.0 mass % of Cr, a balance being 5 mass % or more of Ni and unavoidable elements, and Hastelloy C powder, and a rate of the tetragonal $Mo_2$ (Ni,Cr) $B_2$ is 35 to 95 mass %.

(6) Powder for forming a thermal-sprayed layer according to the present invention is thermal spraying powder which is formed of mixed powder consisting of tetragonal $Mo_2$ (Ni, Cr, V) $B_2$ which contains 7 to 9 mass % of B, 60 to 80 mass % of Mo, 7.5 to 20.0 mass % of Cr, and 0.1 to 10.0 mass % of V, a balance being 5 mass % or more of Ni and unavoidable elements, and Hastelloy C powder, and a rate of the tetragonal $Mo_2$ (Ni, Cr, V) $B_2$ is 35 to 95 mass %.

(7) A method of manufacturing powder for forming a thermal-sprayed layer made of a composite boride cermet of a tetragonal $Mo_2$ (Ni,Cr) $B_2$-type or a tetragonal $Mo_2$ (Ni, Cr, V) $B_2$-type according to the present invention includes the steps of:

preparing mixed powder which contains 4.0 to 6.5 mass % of B, 39.0 to 64.0 mass % of Mo, and 7.5 to 20.0 mass % of Cr, a balance being 5 mass % or more of Ni and unavoidable elements or mixed powder which contains 4.0 to 6.5 mass % of B, 39.0 to 64.0 mass % of Mo, 7.5 to 20.0 mass % of Cr, and 0.1 to 10.0 mass % of V, a balance being 5 mass % or more of Ni and unavoidable elements;

granulating the mixed powder; and sintering the granulated powder at a temperature of 1000 to 1150° C.

(8) Further, a method of manufacturing powder for forming a thermal-sprayed layer made of a composite boride cermet of a tetragonal $Mo_2$ (Ni,Cr) $B_2$-type or an $Mo_2$ (Ni, Cr, V) $B_2$-type according to the present invention includes the steps of:

preparing mixed powder consisting of tetragonal $Mo_2$ (Ni, Cr) $B_2$ which contains 7 to 9 mass % of B, 60 to 80 mass % of Mo, and 7.5 to 20.0 mass % of Cr, a balance being 5 mass % or more of Ni and unavoidable elements or tetragonal $Mo_2$ (Ni, Cr, V) $B_2$ which contains 7 to 9 mass % of B, 60 to 80 mass % of Mo, 7.5 to 20.0 mass % of Cr, and 0.1 to 10.0 mass % of V, a balance being 5 mass % or more of Ni and unavoidable elements, and Hastelloy C;

granulating the mixed powder; and sintering the granulated powder.

Advantageous Effects of the Invention

The highly corrosion-resistant and wear-resistant member with a thermal-sprayed layer formed thereon according to the present invention is the corrosion-resistant and wear-resistant member where the thermal-sprayed layer is formed on the surface of the metallic base material by thermally spraying metallic powder on the metallic base material, wherein the thermal-sprayed layer is made of a composite boride cermet of a tetragonal $M_2$ (Ni, Cr) $B_2$-type or a composite boride cermet of a tetragonal $M_2$ (Ni, Cr, V) $B_2$-type. Accordingly, the highly corrosion-resistant and wear-resistant member with a thermal-sprayed layer formed thereon according to the present invention is excellent as a highly corrosion-resistant and wear-resistant member which is produced by forming a thermal-sprayed layer having corrosion resistance and wear resistance on a surface of a metallic member which is brought into contact with a resin which generates a highly corrosive gas such as a molten fluororesin or PPS, for example, a surface of a resin molding machine member or the like.

Further, powder for forming a thermal-sprayed layer according to the present invention is made of the composite boride cermet of a tetragonal $M_2$ (Ni,Cr) $B_2$-type, and contains 4.0 to 6.5 mass % of B, 39.0 to 64.0 mass % of Mo, and 7.5 to 20.0 mass % of Cr, a balance being Ni and unavoidable elements. Accordingly, powder for forming a thermal-sprayed layer according to the present invention is formed of mainly two phases consisting of a hard phase made of fine composite boride and a binder phase, and is applicable to a thermal-sprayed layer or the like which requires corrosion resistance and wear resistance such as a surface of a metallic member which is brought into contact with a resin which generates a highly corrosive gas such as a molten fluororesin or PPS.

BEST MODE FOR CARRYING OUT THE INVENTION

A thermal-sprayed layer according to the present invention is formed of hard phases mainly made of composite boride of a $M_2$ (Ni,Cr) $B_2$-type or $M_2$ (Ni, Cr, V) $B_2$-type and a binder phase which connects the hard phases and is mainly made of Ni, Cr. Hereinafter, the composition which forms the thermal-sprayed layer of the present invention is explained in detail.

In the present invention, by changing a crystal system of composite boride into a tetragonal crystal from orthorhombic crystal by adding Cr or V to composite boride of $M_2$ (Ni) $B_2$-type which exhibits excellent corrosion resistance, it is possible to form a hard thermal-sprayed layer which possesses high strength and also exhibits excellent corrosion resistance and heat resistance.

A thickness of the thermal-sprayed layer is preferably 0.05 to 5 mm. When the thickness of the thermal-sprayed layer is less than 0.05 mm, a thickness of a thermal-sprayed film is small. Accordingly, it is difficult for the thermal-sprayed layer to acquire advantageous effects which the thermal-sprayed layer according to the present invention is expected to possess, that is, the advantageous effect that corrosion resistance and wear resistance are imparted to a surface of a metallic member which is brought into contact with a resin which generates a highly corrosive gas such as a molten fluororesin or PPS, for example, a surface of a resin molding machine member. On the other hand, when the thickness of the thermal-sprayed layer exceeds 5 mm, the thickness of the thermal-sprayed film becomes large and hence, a residual stress in the thermal-sprayed film is increased whereby cracks are liable to occur in the thermal-sprayed film.

The hard phase mainly contributes to hardness of the thermal-sprayed layer, that is, wear resistance of the thermal-sprayed layer. It is preferable to set a quantity of composite boride of $M_2$ (Ni,Cr) $B_2$-type which constitutes the hard phase within a range of 35 to 95 mass %. When the quantity of composite boride becomes less than 35 mass %, hardness of the thermal-sprayed layer becomes 500 or less in terms of Vickers hardness and hence, wear resistance of the thermal-sprayed layer is lowered. On the other hand, when the quantity of composite boride exceeds 95 mass %, dispersibility of composite boride is deteriorated thus remarkably lowering strength of the thermal-sprayed layer. Accordingly, a rate of composite boride in the thermal-sprayed layer is limited to 35 to 95 mass %.

B is an element indispensable for forming composite boride which constitutes the hard phase in the thermal-sprayed layer, and the thermal-sprayed layer contains 3 to 7.5 mass % of B. When a content of B becomes less than 3 mass %, a quantity of formed composite boride is small and hence, a rate of the hard phase in the structure becomes less than 35 mass % whereby wear resistance of the thermal-sprayed layer is lowered. On the other hand, when the content of B exceeds 7.5 mass %, the rate of hard phase exceeds 95 mass % and hence, strength of the thermal-sprayed layer is lowered. Accordingly, the content of B in the thermal-sprayed layer is limited to 3 to 7.5 mass %.

Mo is, in the same manner as B, an element indispensable for forming the composite boride which constitutes the hard phase. Further, a part of Mo is melted in the binder phase as a solid solution so that Mo enhances wear resistance of the alloy and also enhances corrosion resistance against reduction atmosphere such as a hydrofluoric acid. As a result of various experiments, when a content of Mo becomes less than 21.3 mass %, in addition to lowering of wear resistance and corrosion resistance, Ni boride or the like is formed and hence, strength of the thermal-sprayed layer is lowered. On the other hand, when the content of Mo exceeds 68.3 mass %, a brittle intermetallic compound of a Mo—Ni type is formed and hence, strength of the thermal-sprayed layer is lowered. Accordingly, to maintain corrosion resistance, wear resistance and strength of the alloy, the content of Mo is limited to 21.3 to 68.3 mass %.

Ni is, in the same manner as B and Mo, an element indispensable for forming the composite boride. When a content of Ni is less than 10 mass %, a sufficient liquid phase dose not appear at the time of thermal spraying and hence, a dense thermal-sprayed layer cannot be obtained thus remarkably lowering strength of the thermal-sprayed layer. Accordingly, the remaining part is formed of Ni. This is because when the content of Ni in the binder phase is small, a binding force with composite boride is weakened and, at the same time, strength of the binder phase is lowered thus eventually bringing about lowering of strength of the thermal-sprayed layer.

Cr substitutes Ni in the composite boride by solution treatment, and has an effect of stabilizing the crystal structure of the composite boride in the tetragonal crystal. Further, the added Cr is also present in the binder phase in solid solution, and largely enhances corrosion resistance, wear resistance, high-temperature properties and mechanical properties of the thermal-sprayed layer. When the content of Cr is less than 7.5 mass %, the above-mentioned effect is hardly recognized. On the other hand, when the content of Cr exceeds 20.0 mass %, boride such as $Cr_5B_3$ is formed so that the strength of the thermal-sprayed layer is lowered. Accordingly, the content of Cr is limited to 7.5 to 20.0 mass %.

V substitutes Ni in the composite boride by solution treatment, and has an effect of stabilizing the crystal structure of the composite boride in the tetragonal crystal. Further, the added V is also present in the binder phase in solid solution, and largely enhances corrosion resistance, wear resistance, high-temperature properties and mechanical properties of the thermal-sprayed layer. When the content of V is less than 0.1 mass %, the above-mentioned effect is hardly recognized. On the other hand, when the content of V exceeds 10.0 mass %, boride such as VB is formed so that the strength of the thermal-sprayed layer is lowered. Accordingly, the content of V is limited to 0.1 to 10.0 mass %.

It is needless to say that there is no problem even when extremely small amounts of unavoidable impurities (Fe, Si, Al, Mg, P, S, N, O, C or the like) and other elements (rare earths or the like) which are contained in thermal-spraying powder in a process of manufacturing thermal-spraying powder according to the present invention may be contained to an extent that properties of the thermal-sprayed layer are not spoiled.

Thermal-spraying powder according to the present invention is manufactured in such a manner that metallic powder of Ni, Mo, Cr as a single element or an alloy powder formed of two or more kinds of these elements and powder of B as a single element, or alloy powder formed of one or two or more kinds of elements Ni, Mo and Cr and B, which are indispensable for acquiring the formation of composite boride and for achieving purposes and effects of the thermal-sprayed layer, are subjected to wet grinding in an organic solvent using a vibration ball mill or the like and, thereafter, the powder is granulated using a spray dryer and is sintered (at a temperature of 1100° C. for approximately 1 hour) and, thereafter, the classification is carried out.

It is needless to say that in case of adding W, Cu, Co, Nb, Zr, Ti, Ta, Hf which are added in a suitably selected manner besides Ni, Mo, Cr, a manufacture mode substantially equal to the manufacture mode of the above-mentioned elements can be adopted.

Although composite boride which constitutes the hard phase of the thermal-sprayed layer according to the present invention is formed by a reaction during sintering of the above-mentioned raw material powders, there is no problem even when composite boride of $M_2$ (Ni, Cr) $B_2$-type is manufactured by making boride of Mo, Ni, Cr or powder of B which constitutes a single element and metallic powder of Mo, Ni, Cr react with each other in a furnace, and metallic powder of Ni and Mo having a binder phase composition is added.

It is also needless to say that there is no problem even when composite boride is manufactured in such a manner that a part of Mo of the composite boride is substituted by one or two kinds of W, Nb, Zr, Ti, Ta and Hf or a part of Ni is substituted by one or two kinds or more of Co, Cr, V, and predetermined quantities of other metallic powders are added to the powder to which metallic powder such as Ni is mixed to form the composition of the binder phase.

The wet mixing and grinding of thermal-spraying powder according to the present invention is performed in an organic solvent using a vibration ball mill or the like. Here, it is preferable that an average particle size of powders after grinding using the vibration ball mill becomes 0.2 to 5 μm for securing rapid and sufficient boride forming reaction during sintering. Even when the thermal-spraying powder is ground until the average particle size becomes less than 0.2 μm, an effect brought about by fine grinding is small and also the grinding takes a long time. On the other hand, when the average particle size exceeds 5 μm, the boride forming reaction does not progress rapidly and therefore the particle size of the hard phase at the time of sintering becomes large whereby the thermal-sprayed layer becomes brittle.

Although sintering of the thermal spraying powder differs depending on the composition of an alloy, sintering is carried out at a temperature of 1000 to 1150° C. for 30 to 90 minutes in general. When the sintering temperature is less than 1000° C., a hard phase forming reaction by sintering does not progress sufficiently. On the other hand, when the sintering temperature exceeds 1150° C., a liquid phase is excessively generated thus making thermal spraying powder coarse so that sintering temperature exceeding 1150° C. is not preferable. Accordingly, the final sintering temperature is set to 1150° C. or less. The final sintering temperature is preferably 1100 to 1140° C.

A temperature elevation speed is 0.5 to 60° C./min in general. When the temperature elevation speed is slower than 0.5° C./min, it takes a long time before a predetermined heating temperature is acquired. On the other hand, when the temperature elevation speed is faster than 60° C./min, a temperature control of a sintering furnace becomes extremely difficult. Accordingly, the temperature elevation speed is 0.5 to 60° C./min, and preferably 1 to 30° C./min.

Hereinafter, the present invention is explained specifically by showing embodiments and comparison examples.

Embodiment 1

In the embodiment 1, highly-corrosion-resistant and wear-resistant members with a thermal-sprayed layer formed thereon are manufactured in accordance with following steps. Firstly, raw material metallic powders are mixed so as to form a thermal-sprayed layer content having the composition of specimens 1 to 13 shown in Table 1, and the raw material metallic powders are subjected to wet grinding by a ball mill. Next, powder formed by wet grinding is granulated by a spray dryer, and the granulated powder is sintered by keeping the granulated powder at a temperature of 1100° C. for 1 hour thus forming hard tetragonal $M_2$ (Ni, Cr) $B_2$ by a reaction. Further, by such sintering, paraffin which is a binder for granulation can be removed, and a strength of granulated powder can be also enhanced so as to prevent the power from rupture at the time of thermal spraying. Thereafter, granulated powder after completion of sintering is classified thus completing powder for forming a thermal-sprayed layer.

On the other hand, a surface of an iron-based metallic base material is made coarse by applying shot blasting to a surface layer of the iron-based metallic base material on which a thermal-sprayed layer is formed using shots (white alumina #20).

Then, using HVOF (High Velocity Oxygen Fuel spray) apparatus, metallic powders of specimens 1 to 13 shown in Table 1 are thermally sprayed to the iron-based metallic base material thus forming a thermal-sprayed layer having a thickness of 0.3 mm. The high-speed flame thermal spraying machine used here is HIPOJET-2100 made by METALLIZING EQUIPMENT CO. PVT. LTD, and thermal spraying is carried out under following conditions using the high-speed flame thermal spraying machine.

thermal spraying distance (distance between the base material and thermal spraying gun): 250 mm pressure of oxygen: 8.0 kg/cm$^2$ pressure of propane: 6.0 kg/cm$^2$

TABLE 1

| embodiment, comparison example | composition | corrosion resistance against fluororesin | hardness |
|---|---|---|---|
| embodiment specimen 1 | Ni—5.0% B—20.0% Cr—51.0% Mo | no color change | Hv: 1010 |
| embodiment specimen 2 | Ni—5.0% B—17.5% Cr—51.0% Mo | no color change | Hv: 980 |
| embodiment specimen 3 | Ni—5.0% B—15.0% Cr—51.0% Mo | no color change | Hv: 950 |
| embodiment specimen 4 | Ni—5.0% B—12.5% Cr—51.0% Mo | no color change | Hv: 920 |
| embodiment specimen 5 | Ni—5.0% B—10.0% Cr—51.0% Mo | no color change | Hv: 880 |
| embodiment specimen 6 | Ni—5.0% B—7.5% Cr—51.0% Mo | no color change | Hv: 800 |
| embodiment specimen 7 | Ni—5.0% B—15.0% Cr—55.4% Mo | no color change | Hv: 1150 |
| embodiment specimen 8 | Ni—5.0% B—15.0% Cr—53.2% Mo | no color change | Hv: 1020 |
| embodiment specimen 9 | Ni—5.0% B—15.0% Cr—48.8% Mo | no color change | Hv: 880 |
| embodiment specimen 10 | Ni—5.0% B—15.0% Cr—46.6% Mo | no color change | Hv: 820 |
| embodiment specimen 11 | Ni—5.0% B—15.0% Cr—2.5% V—51.0% Mo | no color change | Hv: 1020 |
| embodiment specimen 12 | Ni—5.0% B—12.5% Cr—5.0% V—51.0% Mo | no color change | Hv: 1050 |
| embodiment specimen 13 | Ni—5.0% B—15.0% Cr—7.5% V—51.0% Mo | no color change | Hv: 1100 |
| comparison example 1 | Ni-based self-fluxing alloy | color changed | Hv: 850 |

Thermal-sprayed layers of specimens 1 to 13 and comparison examples 1, 2 are brought into contact with a molten fluororesin, and the corrosion resistance of the thermal-sprayed layers is evaluated. The thermal-sprayed layers of the specimens 1 to 13 also have hardness of 800 to 1150 in terms of Hv. Accordingly, the specimens 1 to 13 are corrosion-resistant and wear-resistant members provided with the thermal-sprayed layer having proper hardness as a part of a machine for molding a resin such as a fluororesin or PPS which generates a highly corrosive gas. Further, when the thermal-sprayed layers are brought into contact with a molten fluororesin, no color change is observed on surfaces of the thermal-sprayed layers and hence, the specimens can be properly used.

To the contrary, the thermal-sprayed layer formed by thermally spraying a Ni-based self-fluxing alloy formed by the comparison example 1 is brought into contact with a molten fluororesin, color of the surface of the thermal-sprayed layer is changed and hence, the specimen cannot be used.

Embodiment 2

In the embodiment 2, highly corrosion-resistant and wear-resistant members with a thermal-sprayed layer formed thereon are manufactured in accordance with following steps. That is, in the embodiment 2, there is no step of forming a hard alloy by sintering, and binder powder is mixed into hard powder which is prepared in advance.

Firstly, raw material powders are mixed so as to form the mixed powder containing 71.8% of Mo, 8.0% of B, 15.0% of Cr and a balance of Ni. The mixed powder is subjected to wet grinding using a ball mill, is dried, and is subjected to heat treatment at a temperature of 1250° C. for 1 hour thus forming powder as a single body of tetragonal $Mo_2$ (Ni,Cr) $B_2$. Then, powder having corrosion-resistant composition which constitutes a binder is added to the powder.

In this embodiment, to form the thermal-sprayed layers having the compositions of specimens 14 to 17 shown in Table 2, Hastelloy C powder (composition=Ni: 54.0, Mo: 16.0, Cr: 15.5, Fe: 6.0, W: 4.0, V: 0.3, C: 0.01) is added as powder having corrosion-resistant composition. Then, the mixture formed of powder of tetragonal $M_2$ (Ni,Cr) $B_2$ as a single body and powder of Hastelloy C is subjected to wet grinding by a ball mill.

Next, powder obtained by wet grinding is granulated using a spray dryer, and the granulated powder is sintered by keeping the powder at a temperature of 900° C. which is lower than the sintering temperature of embodiment 1 for 1 hour. By sintering, paraffin which is a binder for granulation can be removed, and also a strength of granulated powder can be enhanced so as to prevent the powder from rupture at the time of thermal spraying. Thereafter, granulated powder after completion of sintering is classified thus completing the manufacture of powder for forming a thermal-sprayed layer.

On the other hand, a surface of an iron-based metallic base material is made coarse by applying shot blasting to a surface layer of the iron-based metallic base material on which a thermal-sprayed layer is formed using shots (white alumina #20). Then, using a high-speed flame thermal spraying machine, metallic powders of specimens 14 to 15 shown in Table 2 are thermally sprayed to the iron-based metallic base material thus forming a thermal-sprayed layer having a thickness of 0.3 mm. The high-speed flame thermal spraying machine used here is HIPOJET-2100 made by METALLIZING EQUIPMENT CO. PVT. LTD, and thermal spraying is carried out under following conditions using the high-speed flame thermal spraying machine.

thermal spraying distance (distance between the base material and thermal spraying gun: 250 mm pressure of oxygen: 8.0 kg/cm$^2$ pressure of propane: 6.0 kg/cm$^2$

TABLE 2

| embodiment | composition | corrosion resistance against fluororesin | hardness |
|---|---|---|---|
| specimen 14 | 40.0 mass % $Mo_2$ (Ni, Cr) $B_2$-remaining Hastelloy C | no color change | Hv: 800 |
| specimen 15 | 62.5 mass % $Mo_2$ (Ni, Cr) $B_2$-remaining Hastelloy C | no color change | Hv: 975 |
| specimen 16 | 75.0 mass % $Mo_2$ (Ni, Cr) $B_2$-remaining Hastelloy C | no color change | Hv: 1100 |
| specimen 17 | 90.0 mass % $Mo_2$ (Ni, Cr) $B_2$-remaining Hastelloy C | no color change | Hv: 1250 |

Thermal-sprayed layers of specimens 14 to 17 are brought into contact with a molten fluororesin, and the corrosion resistance of the thermal-sprayed layers is evaluated. The thermal-sprayed layers of the specimens 14 to 17 also have hardness of 800 to 1250 in terms of Hv. Accordingly, the specimens 14 to 17 are corrosion-resistant and wear-resistant members provided with the thermal-sprayed layer having proper hardness as a part of a machine for molding a resin such as a fluororesin or PPS which generates a highly corrosive gas. Further, when the thermal-sprayed layers are brought into contact with a molten fluororesin, no color change is observed on surfaces of the thermal-sprayed layers and hence, the specimens can be properly used.

Embodiment 3

In the embodiment 3, highly corrosion-resistant and wear-resistant members with a thermal-sprayed layer formed thereon are manufactured in accordance with following steps. That is, although the embodiment 3 has the same steps of manufacturing thermal-spraying powder as the embodiment 2, the embodiment 3 differs from the embodiment 2 in the composition of the thermal spraying powder.

Firstly, raw material powders are mixed so as to form the mixed powder containing 71.8% of Mo, 8.0% of B, 10.0% of Cr %, 5.0% of V and a balance of Ni. The mixed powder is subjected to wet grinding using a ball mill, is dried and is subjected to heat treatment at a temperature of 1250° C. for 1 hour thus forming powder of tetragonal $M_2$ (Ni,Cr,V) $B_2$ as a single body. Then, powder having corrosion-resistant composition which constitutes a binder is added to the powder.

In this embodiment, to form the thermal-sprayed layers having the composition of specimens 18 to 21 shown in Table 3, powder of Hastelloy C (composition=Ni: 54.0, Mo: 16.0, Cr: 15.5, Fe: 6.0, W: 4.0, V: 0.3, C: 0.01) is added as powder having corrosion-resistant composition. Then, the mixture of powder in a single form of tetragonal $M_2$ (Ni, Cr, V) $B_2$ and powder of Hastelloy C is subjected to wet grinding by a ball mill.

Next, powder obtained by wet grinding is granulated using a spray dryer, and the granulated powder is sintered by keeping the powder at a temperature of 900° C. which is lower than the sintering temperature of embodiment 1 for 1 hour. By sintering, paraffin which is a binder for granulation can be removed, and also strength of tetragonal $M_2$ (Ni, Cr, V) $B_2$ can be enhanced so as prevent the powder from rupture during thermal spraying. Thereafter, granulated powder after completion of sintering is classified thus completing powder for forming a thermal-sprayed layer.

Then, using a high-speed flame thermal spraying machine, metallic powders of specimens 18 to 21 shown in Table 3 are thermally sprayed to the iron-based metallic base material thus forming a thermal-sprayed layer having a thickness of 0.3 mm. Here, the thermal-sprayed layer is formed on the iron-based metallic base material under the substantially same condition as the embodiment 2.

TABLE 3

| embodiment | composition | corrosion resistance against fluororesin | hardness |
|---|---|---|---|
| specimen 18 | 40.0 mass % $Mo_2$ (Ni, Cr, V) $B_2$-remaining Hastelloy C | no color change | Hv: 850 |
| specimen 19 | 62.5 mass % $Mo_2$ (Ni, Cr, V) $B_2$-remaining Hastelloy C | no color change | Hv: 1000 |
| specimen 20 | 75.0 mass % $Mo_2$ (Ni, Cr, V) $B_2$-remaining Hastelloy C | no color change | Hv: 1150 |
| specimen 21 | 90.0 mass % $Mo_2$ (Ni, Cr, V) $B_2$-remaining Hastelloy C | no color change | Hv: 1300 |

Thermal-sprayed layers of specimens 18 to 21 are brought into contact with a molten fluororesin, and the corrosion resistance of the thermal-sprayed layers is evaluated. The thermal-sprayed layers of the specimens 18 to 21 also have hardness of 850 to 1300 in terms of Hv. Accordingly, the specimens 18 to 21 are corrosion-resistant and wear-resistant members provided with the thermal-sprayed layer having proper hardness as a part of a machine for molding a resin such as a fluororesin or PPS which generates a highly corrosive gas. Further, when the thermal-sprayed layers are brought into contact with a molten fluororesin, no color change is observed on surfaces of the thermal-sprayed layers and hence, the specimens can be properly used.

In the embodiments 2 and 3, some mixing examples of thermal spraying powders to be mixed are exemplified. However, these mixing rates can be suitably changed to form thermal-sprayed layers of the present invention.

INDUSTRIAL APPLICABILITY

As has been explained heretofore, the thermal-sprayed layer according to the present invention which is formed of composite boride of a tetragonal $M_2$ (Ni,Cr) $B_2$-type or a tetragonal $M_2$ (Ni, Cr, V) $B_2$-type and a binder phase is a high hardness member and exhibits excellent corrosion resistance and wear resistant against a molten fluororesin while maintaining excellent corrosion resistance and high-temperature properties. Accordingly, the highly corrosion-resistant and wear-resistant member with the thermal-sprayed layer formed thereon is, as a high-strength and high-wear-resistant material, applicable to various fields such as a cutting tool, an edged tool, a forged mold, a tool for hot or warm working, a roll material, a pump part such as a mechanical seal, a part of an injection molding machine under a highly corrosive atmosphere or the like whereby the industrial applicability of the present invention is extremely high.

The invention claimed is:

1. A corrosion-resistant and wear-resistant member with a thermal-sprayed layer formed thereon, comprising:

a metallic base material; and a thermal-sprayed layer formed on a surface of the metallic base material, the thermal-sprayed layer being made of a composite boride cermet comprising a tetragonal $Mo_2(Ni,Cr,V)B_2$, and wherein the ratio by mass % of Mo to B is 8.9-11.1.

2. The corrosion-resistant and wear-resistant member according to claim 1, wherein a thickness of the thermal-sprayed layer is 0.05 to 5 mm.

3. The corrosion-resistant and wear-resistant member according to claim 1, wherein the thermal-sprayed layer has hardness of 800 to 1300 in terms of Hv.

4. A corrosion-resistant and wear-resistant member with a thermal-sprayed layer formed thereon, comprising a metallic base material, and a thermal-sprayed layer formed on a surface of the metallic base material, the thermal-sprayed layer being made of a composite boride cermet comprising a tetragonal $Mo_2(Ni, Cr)B_2$, and wherein the ratio by mass % of Mo to B is 8.9 to 11.1, wherein a quantity of the composite boride cermet which constitutes a hard phase is set within a range of 35 to 95 mass %.

5. The corrosion-resistant and wear-resistant member according to claim 4, wherein the composite boride cermet contains 4.0 to 6.5 mass % of B, 39.0 to 64.0 mass % of Mo, and 7.5 to 20.0 mass % of Cr, a balance being 5 mass % or more of Ni and unavoidable elements.

6. The corrosion-resistant and wear-resistant member according to claim 4, wherein a thickness of the thermal-sprayed layer is 0.05 to 5 mm.

7. The corrosion-resistant and wear-resistant member according to claim 4, wherein the thermal-sprayed layer has hardness of 800 to 1150 in terms of Hv.

* * * * *